US009504288B2

(12) United States Patent
Ratti et al.

(10) Patent No.: US 9,504,288 B2
(45) Date of Patent: Nov. 29, 2016

(54) PROTECTION HELMET

(71) Applicant: AGV S.P.A., Molvena (VI) (IT)

(72) Inventors: Carlo Filippo Ratti, Villalvernia (IT); Emiliano Taccioli, Sesto San Giovanni (IT)

(73) Assignee: AGV S.P.A., Molvena (VI) (IT)

( * ) Notice: Subject to any disclaimer, the term of this patent is extended or adjusted under 35 U.S.C. 154(b) by 0 days.

(21) Appl. No.: 13/794,160

(22) Filed: Mar. 11, 2013

(65) Prior Publication Data

US 2013/0239304 A1 Sep. 19, 2013

(30) Foreign Application Priority Data

Mar. 13, 2012 (IT) ..... VR2012A0042

(51) Int. Cl.
*A42B 7/00* (2006.01)
*A42B 1/08* (2006.01)
*A42B 3/22* (2006.01)

(52) U.S. Cl.
CPC ..... *A42B 3/221* (2013.01); *A42B 3/223* (2013.01)

(58) Field of Classification Search
CPC ..... A42B 3/08; A42B 3/14; A42B 3/085; A42B 3/223; A42B 3/221
USPC ..... 2/421, 422, 2, 424
See application file for complete search history.

(56) References Cited

U.S. PATENT DOCUMENTS 4,507,809 A * 4/1985 Stepan ..... 2/424
4,514,864 A * 5/1985 Huber ..... 2/424
4,524,465 A * 6/1985 Huber ..... 2/424
4,612,675 A * 9/1986 Broersma ..... 2/424
4,615,052 A * 10/1986 Nava ..... 2/424
4,667,348 A * 5/1987 Sundahl ..... 2/410
4,748,696 A 6/1988 Fohl
4,860,389 A * 8/1989 Morin ..... 2/424
5,093,938 A * 3/1992 Kamata ..... 2/424
5,170,511 A * 12/1992 Kamata ..... 2/424
5,388,277 A * 2/1995 Taniuchi ..... 2/422
5,553,329 A * 9/1996 Casartelli ..... 2/424
5,694,650 A * 12/1997 Hong ..... 2/424
6,105,172 A * 8/2000 Shida ..... 2/171.3

(Continued)

FOREIGN PATENT DOCUMENTS

EP 0287145 10/1988
EP 0534748 3/1993

(Continued)

OTHER PUBLICATIONS

Translation of WO 2011/013902 (CHO) Feb. 3, 2011, see attached of EP 2460425 machine translation.*

(Continued)

*Primary Examiner* — Anna Kinsaul
*Assistant Examiner* — Timothy K Trieu
(74) *Attorney, Agent, or Firm* — Steinfl & Bruno LLP

(57) ABSTRACT

A helmet including an engagement device for engaging a visor with a remaining portion of the helmet is described. The engagement device is adapted to engage the visor in two distinct engagement positions, wherein, in a first engagement position, the visor is in a first spatial relationship with respect to the remaining portion of the helmet and, in a second engagement position; the visor is in a second spatial relationship with respect to the remaining portion of the helmet.

16 Claims, 6 Drawing Sheets

(56) References Cited

U.S. PATENT DOCUMENTS

| | | | | |
|---|---|---|---|---|
| 6,405,382 | B2 * | 6/2002 | Shida | 2/171.3 |
| 7,181,777 | B2 * | 2/2007 | Choi et al. | 2/424 |
| 8,161,577 | B2 * | 4/2012 | Tews | 2/424 |
| 8,176,575 | B2 * | 5/2012 | Tsuzuki | 2/424 |
| 8,375,474 | B2 * | 2/2013 | Arai | 2/424 |
| 2012/0240314 | A1 * | 9/2012 | Cho | 2/424 |

FOREIGN PATENT DOCUMENTS

| | | | | |
|---|---|---|---|---|
| EP | 0685177 | | 12/1995 | |
| EP | 1366683 | | 12/2003 | |
| EP | 1397969 | | 3/2004 | |
| EP | 1591030 | | 11/2005 | |
| EP | 2460425 | A2 * | 6/2012 | |
| FR | 2478960 | | 10/1981 | |
| GB | 2300346 | | 11/1996 | |
| JP | H0413626 | U | 2/1992 | |
| WO | WO 2009/020909 | | 2/2009 | |
| WO | WO 2009020909 | A2 * | 2/2009 | A42B 3/24 |
| WO | WO 2009020909 | A3 * | 4/2009 | |
| WO | WO 2011/013902 | | 2/2011 | |
| WO | WO 2011013902 | A2 * | 2/2011 | |
| WO | WO 2011013902 | A3 * | 3/2011 | |

OTHER PUBLICATIONS

Italian Search Report for Italian Application No. IT VR2012A000042 filed on Mar. 13, 2012 in the name of AGV S.p. A. completion date: Oct. 31, 2012.

Italian Search Report of Nov. 23, 2012 for Italian Application No. ITVR20120022 filed on Feb. 20, 2012 in the name of AGV S.P.A.

Italian Search Report of Sep. 19, 2012 for Italian Application No. ITVR20120023 filed on Feb. 20, 2012 in the name of AGV S.P.A.

* cited by examiner

PROTECTION HELMET

CROSS REFERENCE TO RELATED APPLICATIONS

The present application claims priority to Italian Patent Application VR2012A000042 filed on Mar. 13, 2012, which is incorporated herein by reference in its entirety.

FIELD

The present disclosure relates in general to a protective helmet including an engagement device for engaging or locking a visor with a remaining portion of a helmet, such as a cap, a chin guard or similar portions of the helmet. In particular, the present disclosure relates to a helmet in which the engagement device is able to engage the visor with the remaining portion of the helmet when the visor is in a closed position, namely when the visor closes the front aperture of the helmet.

SUMMARY

According to a first aspect of the disclosure, a helmet is provided wherein the helmet includes an engagement device for engaging a visor with a remaining portion of the helmet, wherein the engagement device is adapted to engage the visor in two distinct engagement positions, wherein, in a first engagement position, the visor is in a first spatial relationship with respect to the remaining portion of the helmet and, in a second engagement position, the visor is in a second spatial relationship with respect to the remaining portion of the helmet.

According to a second aspect of the disclosure a method for engaging a visor of a helmet with a remaining portion of the helmet is provided, wherein said method comprises the step of engaging the visor with the remaining portion of the helmet in a first engagement position in which the visor is in a first spatial relationship with respect to the remaining portion of the helmet, and the step of engaging the visor with the remaining portion of the helmet in a second engagement position, in which the visor is in a second spatial relationship with respect to the remaining portion of the helmet, said second spatial relationship being different from said first spatial relationship.

In particular, the present disclosure is based on the realization, on the part of the inventors of the present patent application, that in the known helmets the engagement device has a limited functionality and that, in contrast, the engagement device can be provided with a structure able to impart to the helmet a greater number of functions. In particular, in the helmet according to the present disclosure it is possible to connect and engage the visor with respect to the cap or other portions of the helmet, in more than one position or spatial relationship, namely in at least two different engagement positions, such as to produce different relative positions of the visor with respect to the remaining portion of the helmet. Essentially, the visor may have two different spatial relationships with respect to the remaining portion of the helmet, wherein both these spatial relationships are engagement positions or locking positions.

Of these spatial relationships, a first spatial relationship may be a relationship in which the visor closes completely a front aperture of the helmet and prevents, or reduces to a minimum, the passage of air inside the cap, and a second relationship may be a relationship in which the visor defines an aperture or micro-aperture or slit with the remaining portion of the helmet and allows air to enter into the cap.

In this way, the engagement device may allow the visor to be kept in two stable positions where it is fastened/locked/engaged with the cap, wherein in one of said positions the passage of air and hence ventilation within the cap is permitted. This ventilation reduces the risk of visor misting up during use. Basically, it is possible to engage the visor with the remaining portion of the helmet in at least two different positions, wherein these different positions have different functions (complete closure, near closure). It is therefore possible to fasten the visor and at the same time allow ventilation of the helmet.

In one embodiment the engagement device comprises a hooking portion associated with one of said visor and said remaining engagement portion and a counter-hooking portion associated with the other one of the visor and the remaining helmet portion.

In the present disclosure, the terms "hooking portion" and "counter-hooking portion" are understood as meaning that one of said "hooking portion" and "counter-hooking portion" includes one or more elements or parts of the helmet suitable for stable interaction with the other one of said "hooking portion" and "counter-hooking portion", such that, between the two portions, a mutual engagement is at least partially formed, this resulting in—at least temporary—retention/locking/engagement of the visor with respect to the remaining helmet portion. Said "hooking portion" and "counter-hooking portion" may be parts or devices associated with the visor and the remaining part of the helmet, or parts formed as one piece namely, for example moulded as one piece, with the visor and the remaining part of the helmet.

In one embodiment, one of the hooking portion and the counter-hooking portion includes at least two elements arranged in a different position and suitable for interacting with one or more elements of the other one of the hooking portion and the counter-hooking portion, wherein the distance between the at least two elements corresponds to the difference in the spatial relationship of the visor with respect to the remaining helmet portion in the two aforementioned positions. In this way, in an operating condition, when one of the two elements of one of the hooking portion and the counter-hooking portion is connected to/engaged with one or more elements of the other one of the hooking portion and the counter-hooking portion, the first of the spatial relationships of the visor is obtained, and when the other one of the two elements of one of the hooking portion and the counter-hooking portion is connected to/engaged with one or more elements of the other one of the hooking portion and the counter-hooking portion, the second of the spatial relationships of the visor is obtained.

In other words, in some embodiments, the engagement device may comprise two hooking elements suitable for being engaged with one or more counter-hooking elements or vice versa, these elements being in a spatial relationship corresponding to the spatial relationship of the visor with respect to the remaining portion of the helmet.

The two elements may be mounted on a single element of the hooking portion or the counter-hooking portion, or the two elements may be mounted in a spaced relationship in different parts/zones of the hooking portion or the counter-hooking portion.

For example, in one embodiment, one of the hooking portion and the counter-hooking portion includes two teeth or protrusions which are suitably spaced from each other, for example offset height-wise, and are suitable for interacting alternately with a corresponding element of the other one of the hooking portion and the counter-hooking portion.

Basically, in some embodiments, in order to obtain a first spatial relationship of the visor, a first tooth/protrusion of the hooking portion interacts with an element of the counter-hooking portion, and in order to obtain a second spatial relationship of the visor, a second tooth/protrusion of the hooking portion interacts with the element of the counter-hooking portion. In other words, in order to obtain the two positions, two teeth of the hooking portion which are spaced from each other and which are suitable for interacting alternately with an element of the counter-hooking portion are used.

In one embodiment, either one of the hooking portion and the counter-hooking portion is mounted on, or directly fastened to, an actuating element or control body, such as a pushbutton, a slider, a lever or a button, intended to operate the engagement device so as to perform engagement and/or release of the visor with respect to the hooking portion. Basically, by operating the actuating element, it is possible to adjust, for example, the hooking portion and modify the engagement with the counter-hooking portion and pass from one position to the other, or it is possible to free completely the connection between the hooking portion and the counter-hooking portion.

In this way, by actuating the actuating element, the hooking portion is displaced with respect to the counter-hooking portion, releasing a connection with the counter-hooking portion, and allowing a movement of the visor so as to obtain the first spatial relationship and/or the second spatial relationship of the visor with respect to the remaining portion of the helmet, or opening of the visor.

In one embodiment the actuating element is a hollow body with a substantially U-shaped cross-section. This hollow body defines a seat suitable for receiving the counter-hooking portion. In particular, the hooking portion is fastened to a wall of the hollow body. In this way, when the visor is moved towards the remaining portion of the helmet, into a closed condition, the counter-hooking portion is inserted into the hollow body and interacts with the hooking portion. For example, the counter-hooking portion interacts with the first of the aforementioned two elements (for example the teeth/protrusions), in order to obtain the first spatial relationship of the visor with respect to the remaining cap portion, and, subsequently, by moving also the hooking portion in the seat, with the second of the aforementioned two elements (for example the teeth/protrusions), in order to obtain the second spatial relationship of the visor with respect to the remaining cap portion.

In other words, in one embodiment, in order to obtain the first spatial relationship of the visor with respect to the remaining portion of the helmet, by operating the actuating element the counter-hooking portion is displaced/slid along the hooking portion until the counter-hooking element is blocked by the first tooth (first element) of the hooking portion. Moreover, in order to obtain the second spatial relationship of the visor, by operating the actuating element, the counter-hooking portion is displaced/slid along the hooking portion until the counter-hooking portion is blocked by the second tooth (second element) of the hooking portion. For example, starting with the condition where the visor is open, it is possible to pass from a condition in which the visor forms a gap or slit with the cap (and in which the counter-hooking portion interacts with the first tooth) and then into a condition in which the visor closes the cap completely (and in which the counter-hooking portion interacts with the second tooth).

Further aspects of the disclosure are shown in the specification, drawings and claims of the present application.

Figure 1:
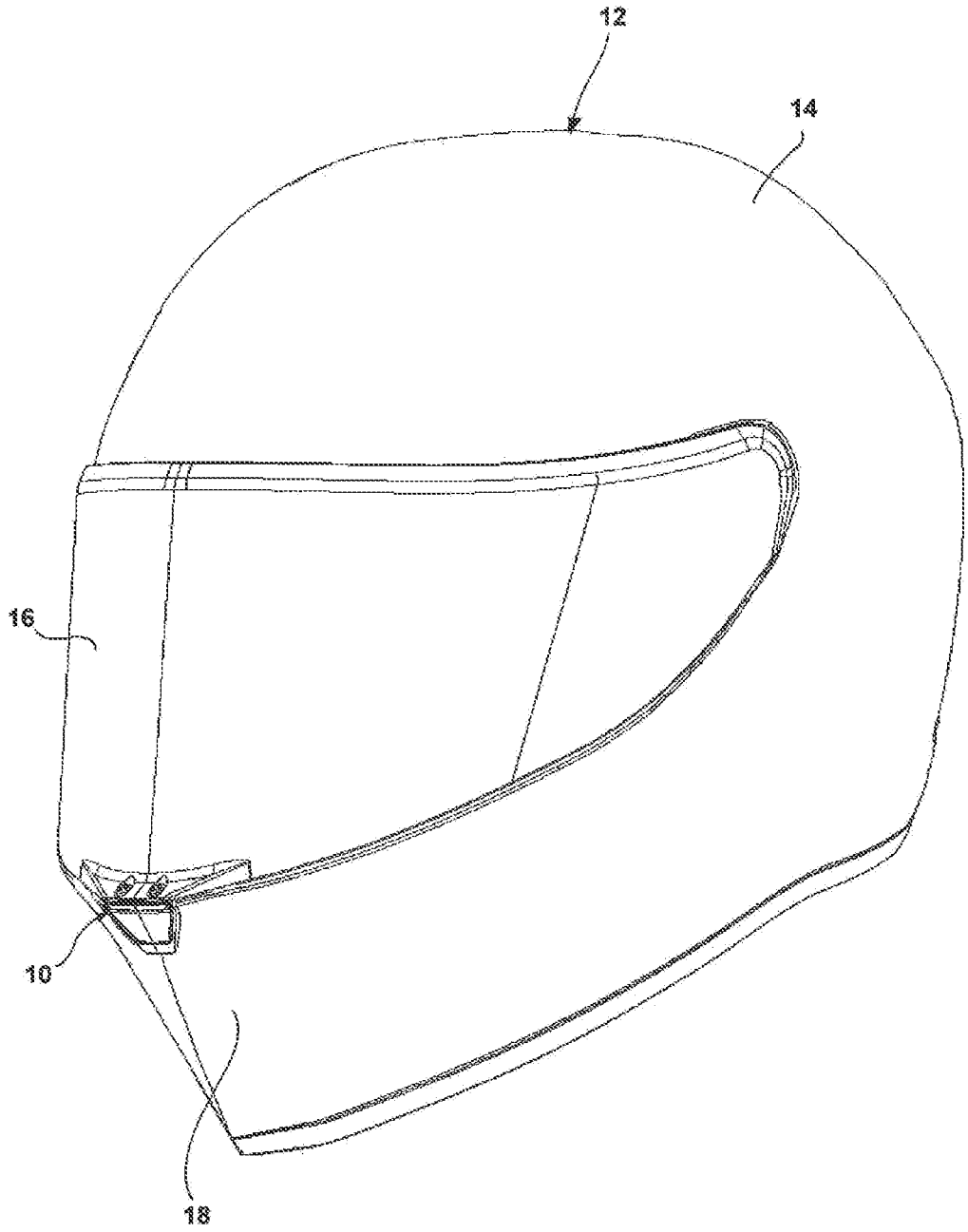
FIG. 1 shows a view of a helmet according to an embodiment of the present disclosure, in which the visor is in an engaged and closed condition.
Figure 2:
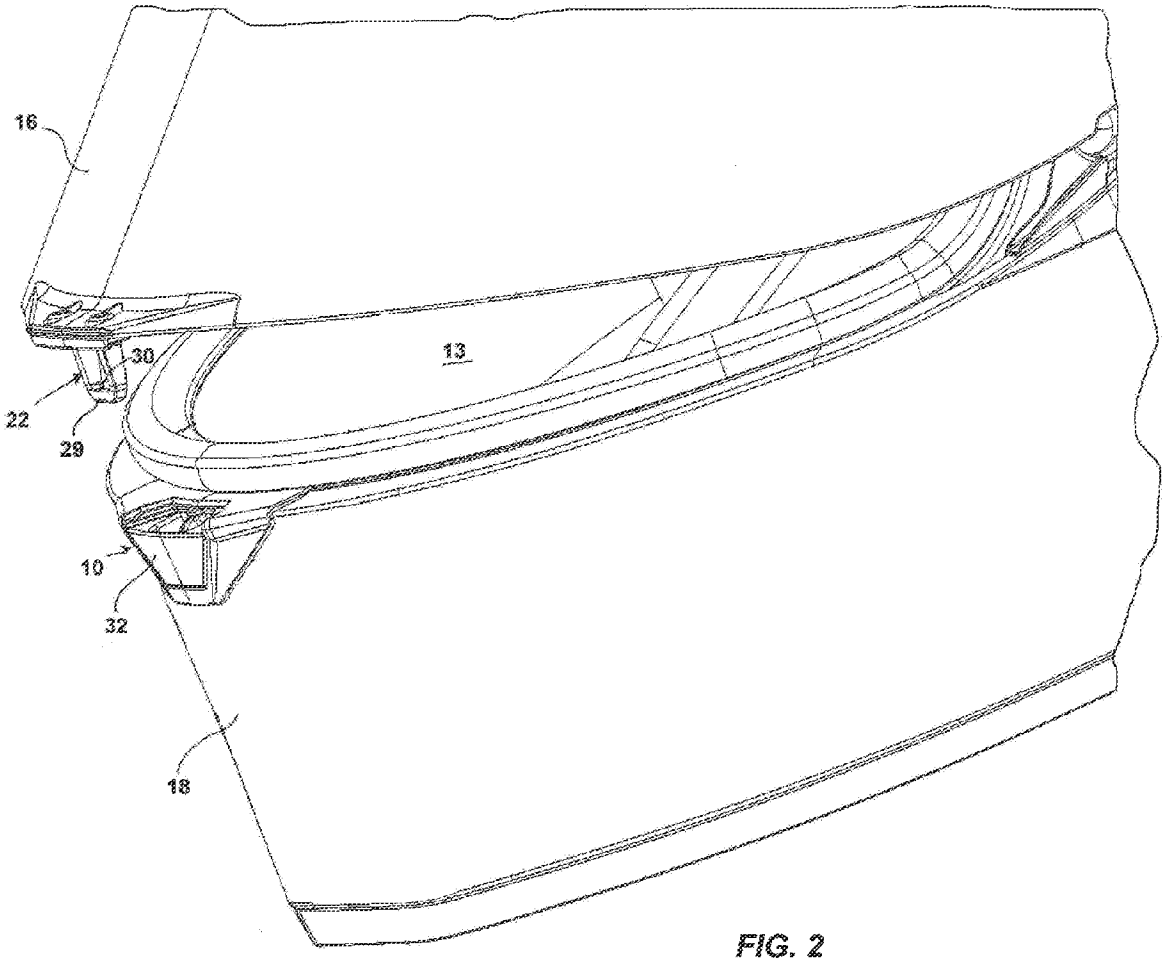
FIG. 2 shows a view, on a larger scale, of a detail of the helmet according to FIG. 1 in a disengaged condition.
Figure 3:
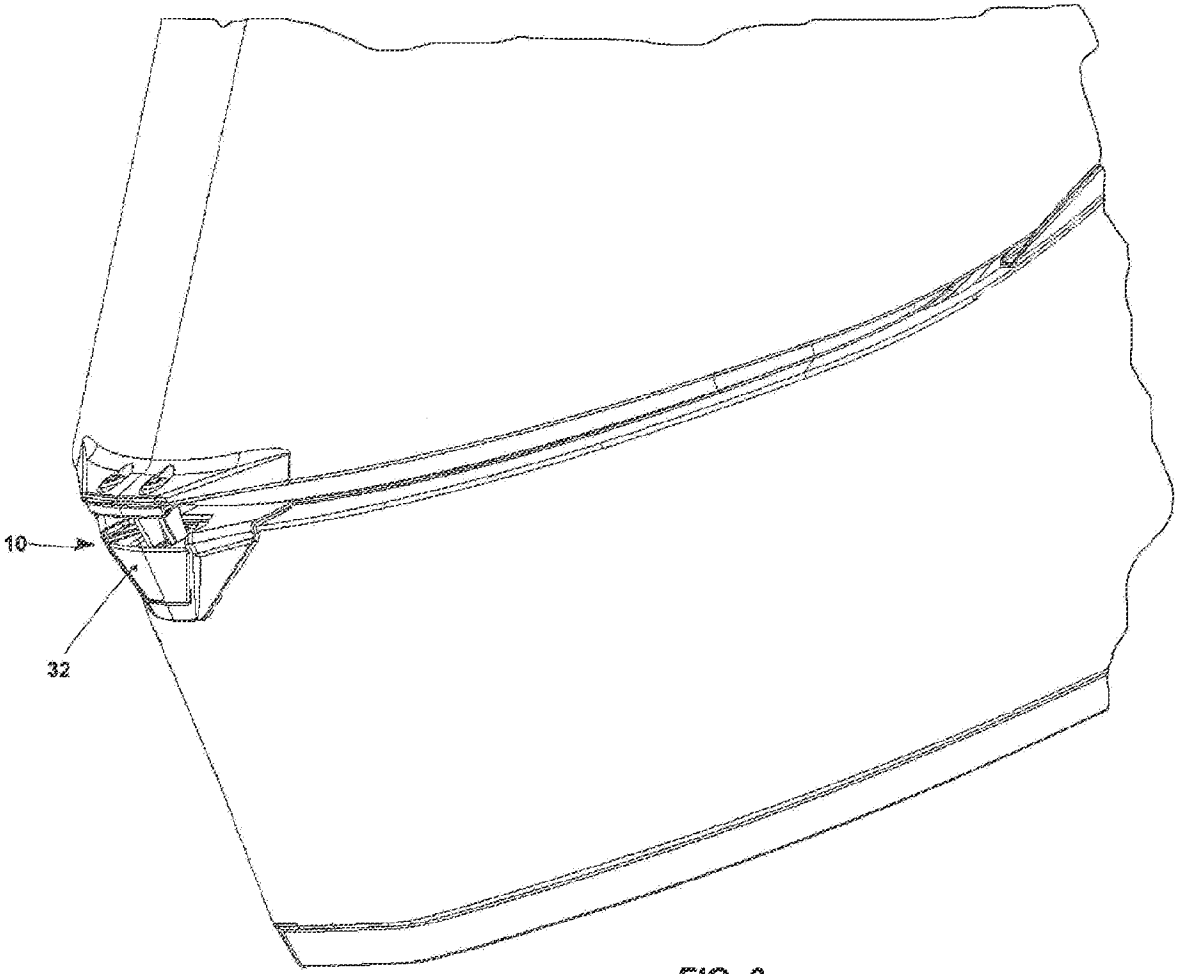
FIG. 3 shows a view of a detail of the helmet according to FIG. 1 in an engaged micro-aperture or nearly closed condition.

With reference to the attached figures, the reference number 12 denotes a helmet according to an embodiment of the present disclosure including an engagement device 10.

In particular, in the example shown in the figures, the engagement device 10 is applied to a helmet 12 including a cap 14 for protecting the head of a user and a visor 16. The cap 14 includes a chin guard 18 suitable for protecting the jaw and the chin zone of a user. The engagement device 10 is intended to connect and engage the visor 16 with respect to the cap 14 of the helmet 12 and allow the visor to remain stably closed on the cap 14.

Even more particularly in the embodiment shown, the visor 16 is engaged with the chin guard 18 of the helmet 12. The visor 16 is able to assume at least one closed position or condition in which the visor 16 is connected stably, or locked, to the cap 14 and protects the face of a user, and an open and disengaged position in which the visor 16 is disengaged and released from the cap 14. In the closed position, the visor 16 closes the front aperture 13 of the helmet 12.

Figure 4:
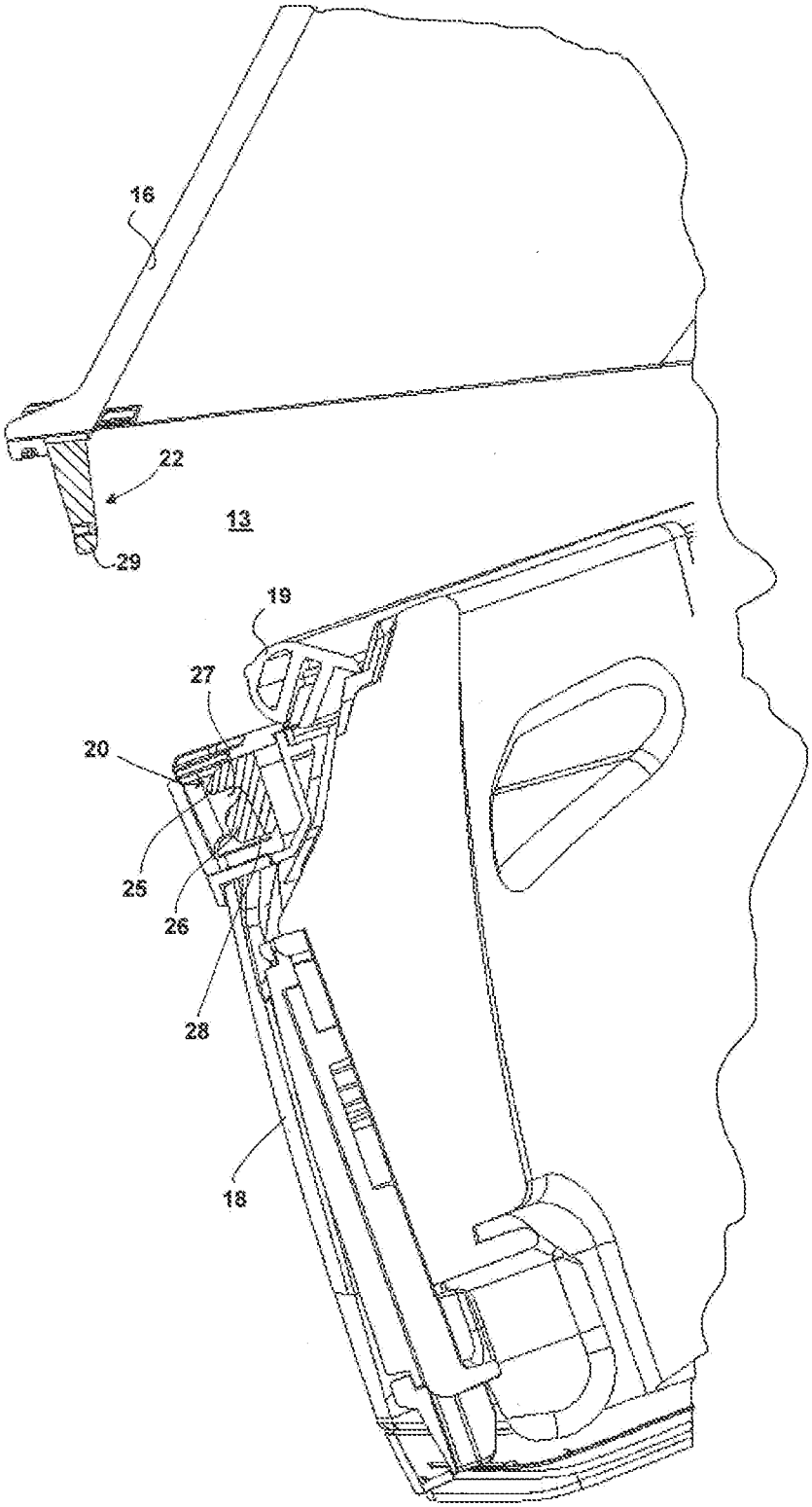
FIGS. 4-6 show cross-sectional side views of a detail of a helmet according to an embodiment of the present disclosure in respective operating conditions.

More particularly, the engagement device 10 includes a hooking portion 20 associated with one of said visor 16 and the chin guard 18, in the present example with the chin guard 18, and a counter-hooking portion 22 associated with the other one of said visor 16 and said chin guard 18, in the present example the visor 16. The counter-hooking portion 22 is adapted to interact with the hooking portion 20 when the visor 16 is in the closed position According to an important aspect of the present disclosure (as seen, for example, in FIG. 4), the hooking portion 20 is adapted to engage with the counter-hooking portion 22 in two distinct engagement positions, wherein a first engagement position corresponds to a first position or first spatial relationship of the visor 16 with respect to the cap 14 and a second engagement position corresponds to a second position or second spatial relationship of the visor 16 with respect to the cap 14.

Even more particularly, the first position of the visor 16 is a position where the visor 16 is completely closed onto the cap 14, namely a condition where the visor adheres fully onto the cap 14 (if necessary assisted by the presence of a seal 19 against which the visor 16 rests) and such as to prevent the passage of air or reduce to a minimum the passage of air between the visor 16 and the cap 14.

Figure 5:
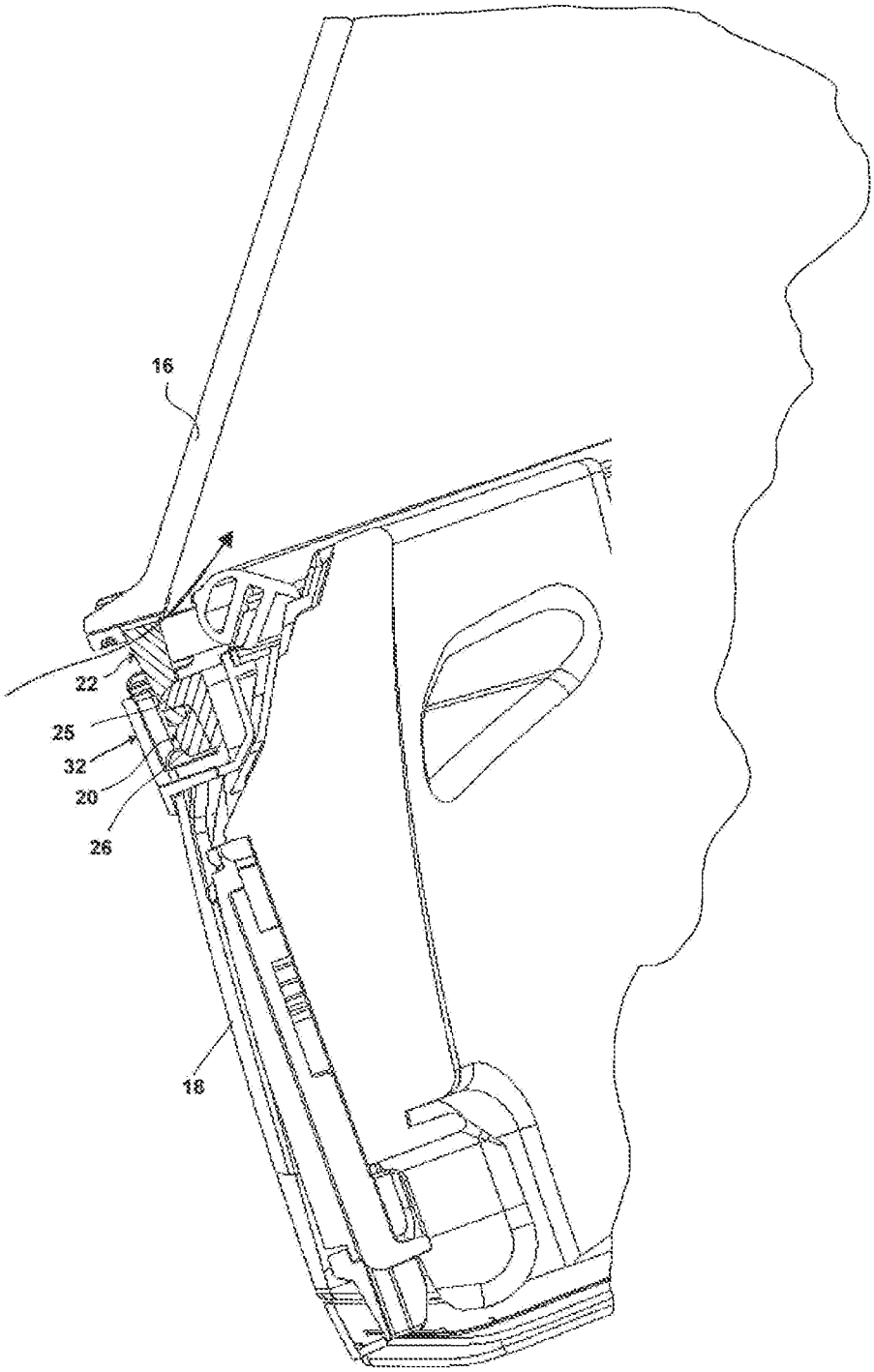
Figure 6:
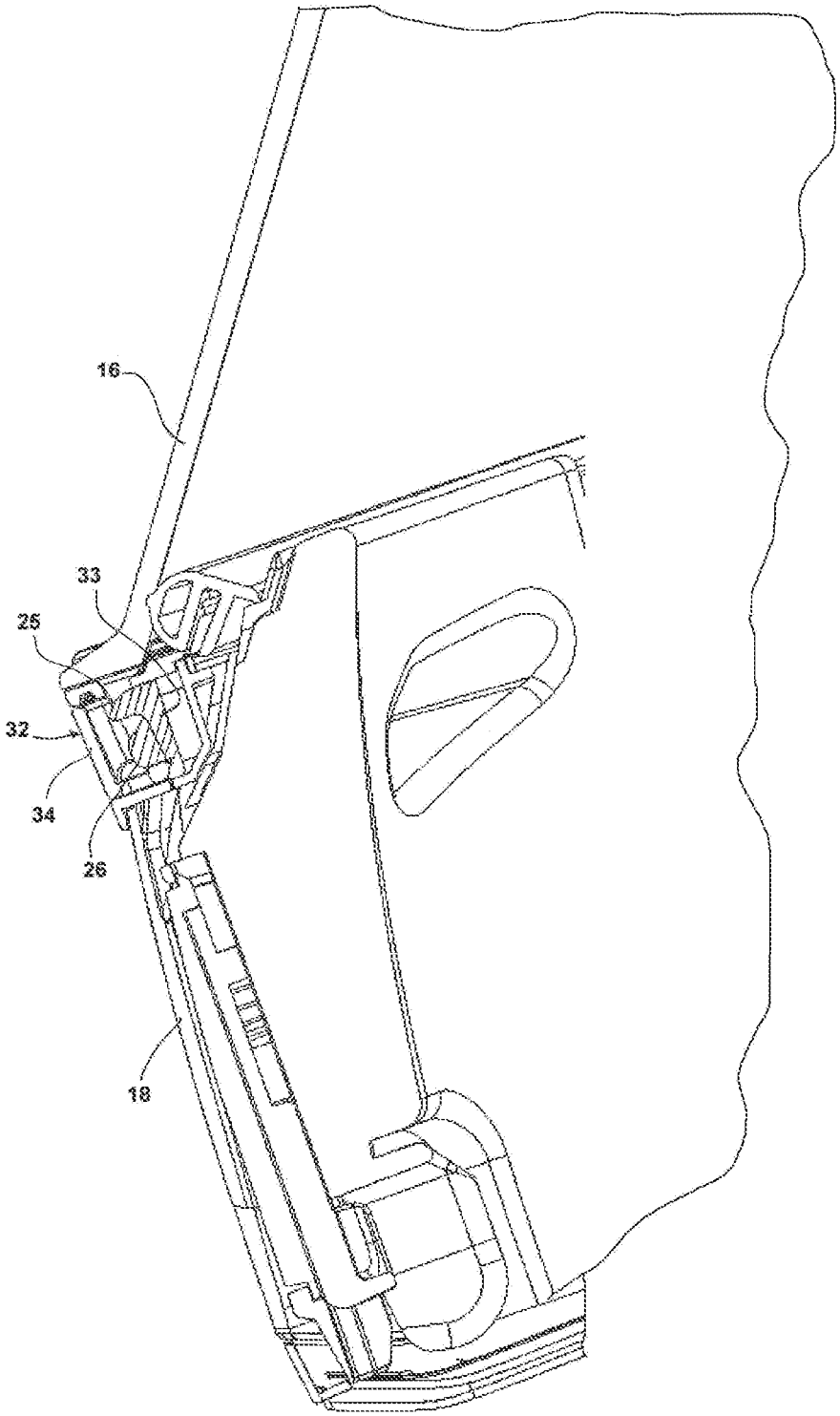

The second position of the visor 16 is a position where the visor 16 is nearly closed onto the cap 14, also referred to as "micro-aperture position", namely a condition in which the visor 16 is engaged with the cap 14 in such a way as to define a slit or opening which allows air to pass between the visor 16 and the cap 14 (the passage of air is indicated by an arrow in FIG. 5). In the embodiment shown and with reference to FIGS. 2-6, the hooking portion 20 comprises two teeth 25, 26 which are arranged above each other in a height-wise direction. The two teeth 25, 26 are shoulders or protrusions which define a respective undercut 27, 28.

The counter-hooking portion 22 is, in the embodiment shown, a ring-shaped element, namely an element defining a cavity 30 and having a transverse portion 29 intended to engage with the respective teeth 25, 26. In particular, the hooking portion 22 is adapted to receive inside the cavity 30, in a first position, the first tooth 25 so as to obtain engagement between the first tooth 25 and the transverse portion 29 and, in a second position, lower than the first position, the second tooth 26 so as to obtain engagement between the second tooth 26 and the transverse portion 29.

According to one embodiment, such as that shown in the drawings, the first tooth 25 and the second tooth 26 have rounded profiles so as to favour sliding of the transverse portion 29 on the said teeth between the first position and the second position, and vice versa, and therefore assist the transition between the first position and the second position, and vice versa.

According to a further embodiment such as that shown in the drawings, the engagement device 10 is associated with an actuating element 32, in the example in the form of a pushbutton or pressure-operated button, which is arranged in a central front area of the chin guard 18. In the example of embodiment, the hooking portion 20 is mounted directly on the actuating element 32 which is shaped to receive the counter-hooking portion 22.

The actuating element 32 is suitable for being operated by a user in order to free engagement between the hooking portion 20 and the counter-hooking portion 22. In this connection it should be noted that the actuating element 32 is mounted movably in the chin guard 18 so as to be able to be pressed by the user and move inwards under the pressure exerted by the user. Moreover, the actuating element 32 is connected to an opposition spring (not visible in the drawings) which normally keeps, in the rest position, the actuating element 32 in an outwardly projecting position.

Even more particularly, the actuating element 32 supports the hooking portion 20 of the engagement device 10. For example, the first tooth 25 and the second tooth 26 are fastened, for example formed as a single body or as one piece, with the actuating element 32. In this way, actuation of the actuating element 32, for example by means of pressure, causes a displacement of the first and second tooth 25, 26, for example towards the inside of the cap 14, and therefore disengagement of the first and/or the second tooth 26 relative to the counter-hooking portion 22, when the latter is received inside the actuating element 32.

Even more particularly, the actuating element 32 is a hollow body with a substantially U-shaped cross-section and including two opposite side walls 33, 34. In particular, the actuating element 32 is open towards the visor 16 so as to define a receiving seat for the counter-hooking portion 22. The first wall 33 is an inner wall directed towards the inside of the cap 14.

The actuating element 32 supports, on the first side wall 33, the first tooth 25 and the second tooth 26. The second side wall 34 is directed towards the outside of the cap 14 and is intended to be pressed on the outside by a user. In other words, according to an embodiment of the present disclosure, the actuating element 32 supports the hooking portion 20 of the engagement device 10 and is such as to allow the visor 16 to be engaged in two different positions with respect to the cap 14.

Below operation of the engagement device 10, starting from an open position of the visor 16 with respect to the cap 14, is described, wherein, in this open position, the visor 16 is separated from the cap 14. In particular, starting from the open position, the visor 16 is lowered until the counter-hooking portion 22 is inserted inside the seat of the actuating element 32 of the chin guard 18 so as to interact with the hooking portion 20. In particular, the counter-hooking portion 22 is inserted between the wall 34 of the actuating element 32 and the teeth 25, 26.

The visor 16 is, for example, lowered until the counter-hooking portion 22 cooperates with the first tooth 25. In particular, by displacing/sliding the counter-hooking portion 22 along the profile of the first tooth 25, the visor 16 may be placed in a semi-closed position. In fact, the visor 16 may be moved until the counter-hooking portion 22 (and more particularly the transverse portion 29) is blocked by the first tooth 25 of the hooking portion 20. Basically, the first tooth 25 is received inside the counter-hooking portion 22 and, owing to the resilient return movement of the spring on which the hooking element 20 is mounted; it retains the visor 16 owing to the contrasting action of rigid parts.

The visor 16 is thus locked in a semi-closed or micro-aperture position such as to allow the passage of air inside the cap. In this semi-closed or micro-aperture or partially open position, the visor cannot be freely raised. In fact, in order to release engagement with the first tooth 25, the actuating element 32 must be pressed again, so as to displace the first tooth 25. Then it is possible to actuate again the actuating element 32 in order to obtain complete closure of the visor.

In particular, for this purpose, the user presses the actuating element 32, in order to lower completely the visor 16 towards the chin guard 18. The counter-hooking portion 22 is freed from the first tooth 25 and presses against the bottom of the seat defined in the actuating element 32 until it is locked by the second tooth 26 of the hooking portion 20. In particular, said second tooth 26 is received inside the counter-hooking portion 22 and retains the visor 16 owing to the contrasting action of rigid parts. The visor 16 is thus locked in the closed position and cannot be raised.

Basically, according to one embodiment of the present disclosure, it is possible to engage the visor 16 with the cap 14, or with the chin guard 18, so as to obtain two different positions of the visor 16 with respect to the chin guard 18, wherein, in a first position, the visor 16, although engaged, forms a slit or aperture with the cap and/or with the chin guard 18 so as to allow the passage of air, while in a second position the visor 16 closes completely the cap 14 so as to prevent or reduce to a minimum the passage of air via the front aperture.

The examples set forth above are provided to give those of ordinary skill in the art a complete disclosure and description of how to make and use the embodiments of the disclosure, and are not intended to limit the scope of what the inventors regard as their disclosure. Modifications of the above-described modes for carrying out the disclosure may be used by persons of skill in the art, and are intended to be within the scope of the following claims. All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. A helmet including an engagement device for engaging a visor with a remaining portion of the helmet, wherein the remaining portion of the helmet is a cap which defines a front aperture; and the engagement device is a device configured to retain the visor in two distinct and stable engagement positions with respect to the front aperture of the cap, the engagement device comprising a hooking portion and a counter-hooking portion, each of which is affixed to one of said visor and said remaining portion of the helmet; wherein the hooking portion comprises two teeth which are arranged above each other in a height-wise direction;

wherein, a first stable engagement position where the visor closes the front aperture, the engagement device locks the visor in a first spatial relationship with respect to the front aperture of the cap through engagement between a first tooth of the hooking portion and an element of the counter-hooking portion and, wherein a second stable engagement position where the visor is in a stable, semi-closed or partially open position, the engagement device locks the visor in a second spatial relationship with respect to the front aperture of the cap through engagement between a second tooth of the hooking portion and the element of the counter-hooking portion.

2. The helmet according to claim 1, wherein the counter-hooking portion is shaped to define a cavity.

3. The helmet according to claim 1, further comprising an actuating element, wherein the actuating element is adapted to be actuated to remove a connection between the visor and the remaining portion of the helmet and the engagement device is associated with the actuating element.

4. The helmet according to claim 3, wherein the actuating element is a push-button movably mounted in the helmet and adapted to be actuated by a user against an action of a spring.

5. The helmet according to claim 3, wherein the hooking portion is mounted on the actuating element, or is part of said actuating element.

6. The helmet according to claim 5, wherein the actuating element is a hollow body including two opposite walls, said actuating element being open so as to define a receiving seat for the counter-hooking portion, and wherein said two teeth of said hooking portion are fixed to one of said opposite walls.

7. The helmet according to claim 3, wherein the actuating element is arranged in a front central area of the helmet and is associated with a chin guard of the helmet.

8. The helmet according to claim 1, wherein the visor is removably secured when locked in the second stable engagement position.

9. The helmet according to claim 1, wherein in the second stable engagement position, the visor defines an opening or slit with respect to the remaining portion of the helmet to allow the passage of air from the front aperture.

10. A method for engaging a visor of a helmet with a remaining portion of the helmet, the remaining portion of the helmet being a cap which defines a front aperture, the method comprising:

retaining the visor with the remaining portion of the helmet by means of an engagement device in a first engagement position in which the visor is in a first spatial relationship with respect to the remaining portion of the helmet to close the front aperture, and retaining the visor with the remaining portion of the helmet by means of said engagement device in a second engagement position, in which the visor is in a second spatial relationship with respect to the remaining portion of the helmet, said second spatial relationship being different from said first spatial relationship, wherein the engagement device comprises a hooking portion and a counter-hooking portion, each of which is affixed to one of said visor and said remaining portion of the helmet, wherein the hooking portion comprises two teeth which are arranged above each other in a height-wise direction;

wherein the first engagement position, the visor securely closes the front aperture through engagement between a first tooth of the hooking portion and an element of the counter-hooking portion, and wherein the second engagement position the visor partially and securely closes the front aperture through engagement between a second tooth of the hooking portion and the element of the counter-hooking portion.

11. The method according to claim 10, wherein the hooking portion is associated with an actuating element, wherein said actuating element is actuated to release said hooking portion with respect to the counter-hooking portion of the helmet and wherein, starting from the first spatial relationship and/or from the second spatial relationship of the visor with respect to the remaining portion of the helmet, by activating the actuating element, the hooking portion is displaced with respect to the counter-hooking portion disengaging a connection with the counter-hooking portion and allowing a movement of the visor.

12. The method according to claim 11, wherein, in order to obtain the first spatial relationship of the visor with respect to the remaining portion of the helmet, the counter-hooking portion is displaced/slid along the hooking portion, until the counter-hooking portion is blocked by the first tooth of the hooking portion, and wherein, in order to obtain the second spatial relationship of the visor, the counter-hooking portion is displaced/slid along the hooking portion until the counter-hooking portion is blocked by the second tooth of the hooking portion.

13. A helmet including an engagement device for engaging a visor with a remaining portion of the helmet, wherein the remaining portion of the helmet is a cap which defines a front aperture; and the engagement device is located in front of the front aperture of the helmet and includes a hooking portion fixedly associated with one of said visor and the remaining portion of the helmet, and a counter-hooking portion fixedly associated with the other one of said visor and the remaining portion of the helmet; wherein the hooking portion comprises two teeth which are arranged above each other in a height-wise direction;

wherein the hooking portion of the engagement device is configured to stably engage with, or be fastened to the counter-hooking portion in two distinct engagement positions, wherein when the hooking portion is in a first engagement position with the counter-hooking portion, the visor firmly closes the front aperture of the cap through engagement between a first tooth of the hooking portion and an element of the counter-hooking portion and when the hooking portion is a second engagement position with the counter-hooking portion, the visor is locked with or fastened to the remaining portion of the helmet spaced apart from the front aperture to define a slit with respect to the front aperture and the visor through engagement between a second tooth and the element.

14. The helmet according to claim 13, wherein the visor is removably secured when locked in the second engagement position.

15. A helmet including an engagement device for engaging a visor with a remaining portion of the helmet, wherein the remaining portion of the helmet is a cap which defines a front aperture; and the engagement device located in a front region of the remaining portion comprises a hooking portion and a counter-hooking portion, each of which is affixed to one of said visor and said remaining portion of the helmet, and is configured to stably retain the visor in said front region; wherein the hooking portion comprises two teeth which are arranged above each other in a height-wise direction;

wherein a first position where the visor firmly closes the front aperture of the cap through engagement between a first tooth of the hooking portion and an element of the counter-hooking portion and wherein a second position where the visor is spaced apart from the front aperture to define a slit with respect to the front aperture through engagement between a second tooth, of the hooking portion and the element of the counter-hooking portion, the visor being retained to the remaining portion of the helmet in both the first position and second position via the engagement device.

16. The helmet according to claim 15, wherein the visor is removably secured when in the second position.

* * * * *